United States Patent [19]

Murata et al.

[11] Patent Number: 4,816,435

[45] **Date of Patent: * Mar. 28, 1989**

[54] TRANSFER SHEET FOR THERMAL TRANSFER RECORDING

[75] Inventors: Yukichi Murata, Sagamihara; Shuichi Maeda, Saitama, both of Japan

[73] Assignee: Mitsubishi Chemical Industries Limited, Tokyo, Japan

[ * ] Notice: The portion of the term of this patent subsequent to Sep. 30, 2003 has been disclaimed.

[21] Appl. No.: 54,606

[22] Filed: May 27, 1987

[51] Int. Cl.[4] ..... B41M 5/035; B41M 5/26

[52] U.S. Cl. ..... 503/227; 8/471; 428/195; 428/216; 428/335; 428/336; 428/473.5; 428/480; 428/913; 428/914

[58] Field of Search ..... 8/470, 471; 428/195, 428/913, 914, 216, 335, 336, 473.5, 480; 503/227

[56] References Cited

U.S. PATENT DOCUMENTS 4,614,521 9/1986 Niwa et al. ..... 8/471

FOREIGN PATENT DOCUMENTS 0229791 11/1985 Japan ..... 428/913

*Primary Examiner*—Bruce H. Hess

*Attorney, Agent, or Firm*—Jordan B. Bierman

[57] ABSTRACT

A transfer sheet for thermal transfer recording system having a color material layer containing sublimable dyes on one surface of a base film, and said color material layer is a black color material layer containing sublimable dyes represented by following formulae (I), (II) and (III);

(I)

(II)

(III)

in the above formulae, X and Y represent a hydrogen atom or a methyl group; —A— represents —CO—, —COO—, or —$SO_2$—; and $R^1$, $R^2$, $R^3$, $R^4$, $R^5$, $R^6$, and $R^7$ represent a hydrogen atom or a substituted or unsubstituted alkyl group.

12 Claims, No Drawings pound wherein X is a methyl group, $R^1$ is an alkyl group having from 1 to 4 carbon atoms, and $R^2$ is a phenyl-substituted alkyl group having from 7 to 9 total carbon atoms is particularly preferred.

As the alkyl group for the substituted or unsubstituted alkyl group shown by $R^3$ and $R^4$ in formula (II) showing a magenta dye for use in this invention, there are an alkyl group having from 1 to 4 carbon atoms, examples of the substitutent of the substituted alkyl group being —OH, —$OCH_3$, and —CN, and a phenyl-substituted alkyl group having from 7 to 9 total carbon atoms. In the compound represented by formula (II) described above, the compound wherein $R^3$ is an alkyl group having from 1 to 4 carbon atoms and $R^4$ is an alkyl group having from 1 to 4 carbon atoms substituted by a methoxy group is particularly preferred.

As the examples of the substituted or unsubstituted alkyl group shown by $R^5$ and $R^6$ in formula (III) showing a cyan dye for use in this invention, there are an alkyl group having from 1 to 4 carbon atoms, an alkyl group having from 1 to 4 carbon atoms substituted by -OH, and a phenyl-substituted alkyl group having from 7 to 9 total carbon atoms. Also, as the examples of the substituted or unsubstituted alkyl group shown by $R^7$ in the aforesaid formula, there are an alkyl group having from 1 to 4 carbon atoms and an alkyl group having from 1 to 4 carbon atoms substituted by a methoxy group and as —A— in the formula, there are —CO—, —COO—, and —$SO_2$—. In the compound represented by formula (III), the compound wherein $R^5$ to $R^7$ are an alkyl group having from 1 to 4 carbon atoms and as —A— —CO— is particularly preferred.

The black color material layer of the black transfer sheet of this invention is obtained by compounding the yellow dye shown by formula (I) described above, the magenta dye shown by formula (II) described above, and the cyan dye shown by formula (III) described above at an optional ratio but it is preferred to compound these dyes on considering the molecular extinction coefficient and the sublimability of each dye so that the color densities of the recorded dyes obtained are matched.

The compounding ratio of these dyes is properly from 10 to 50% by weight for the yellow dye, from 10 to 50% by weight for the magenta dye, and from 30 to 80% by weight for the cyan dye; preferably from 15 to 35% by weight for the yellow dye, from 10 to 25% by weight for the magenta dye, and from 45 to 65% by weight for the cyan dye; and particularly preferably from 18 to 28% by weight for the yellow dye, from 18 to 28% by weight for the magenta dye, and from 50 to 65% by weight for the cyan dye.

In a preferred embodiment of this invention, a yellow dye, a magenta dye, and a cyan dye shown by following formulae (IV), (V), and (VI), respectively are used as a compound of them;

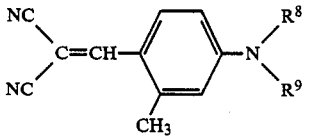

(IV)

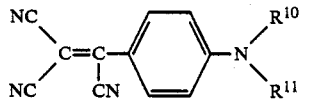

(V)

-continued

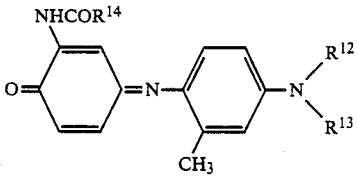

(VI)

in the above formulae, $R^8$, $R^{10}$, $R^{12}$, $R^{13}$, and $R^{14}$ represent an alkyl group having from 1 to 4 carbon atoms; $R^9$ represents a phenyl-substituted alkyl group having from to 9 carbon atoms; and $R^{11}$ represents an alkyl group having from 1 to 4 carbon atoms substituted by a methoxy group.

In a particularly preferred embodiment of this invention, a practical example of the compounding dyes is composed of the following combination;

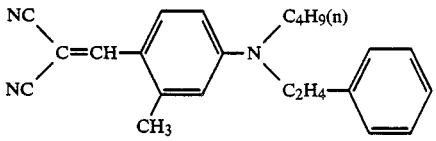

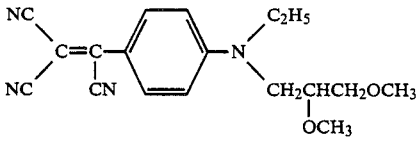

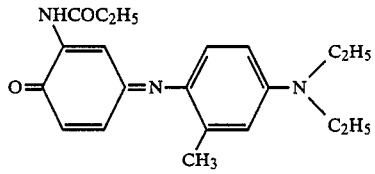

At compounding the dyes, it is necessary to compound at least one yellow dye shown by formula (I), at least one magenta dye shown by formula (II) and at least one cyan dye shown by formula (III) in this invention. In other words, the dyes shown by each of formulae (I), (II), and (III) described above may be used singly or as a mixture of two or more.

In the case of applying the aforesaid compounding dyes for the thermal transfer sheet of this invention, an ink is prepared by dissolving the dyes in a medium together with a binder or dispersing them in a medium as fine particles and the ink is coated on a base film followed by drying to form the color material layer on the base film.

Examples of the binder for making the ink are water-soluble resins such as cellulose series resins, acrylic acid series resins, starch series resins, etc., and resins soluble in an organic solvent or water, such as acrylic resins, methacrylic resins, polystyrene, polycarbonate, polysulfone, polyether sulfone, polyvinyl butyral, ethyl cellulose, acetyl cellulose, etc. In the case of the organic solvent-soluble resin, the resin can be used not only as an organic solvent solution thereof but also as the form of an aqueous dispersion thereof.

As the medium for preparing the ink in this invention, there are, in addition to water, alcohols such as methanol, isopropanol, isobutyl alcohol, etc.; cellosolves such

TRANSFER SHEET FOR THERMAL TRANSFER RECORDING

FIELD OF THE INVENTION

This invention relates to a transfer sheet for sublimation type thermal transfer recording. More particularly, the invention relates to a transfer sheet for sublimation type thermal transfer recording having a black color material-containing layer.

BACKGROUND OF THE INVENTION

Hitherto, color recording techniques for facsimille printers, copying machines, or television images have been desired and color recording techniques by electrothermal ink jet printings, thermal transfer recording, etc., have been investigated.

In these techniques, a thermal transfer recording system is considered to be advantageous as compared to other systems since in this system, the apparatus can be easily maintained and operated and also the apparatus supplies are inexpensive.

As a thermal transfer recording system, there are a melting system wherein a transfer sheet having heat-meltable ink layer formed on a base film is heated by a heating means such as thermal head, infrared rays, etc., to melt the ink and molten ink is transferred onto a recording material to perform recording and a sublimation system wherein a transfer sheet having an ink layer containing sublimable dyes formed on a base film is heated by a heating means to sublime the dyes and the sublimed dyes are transferred onto a recording material to perform recording. In the sublimation system, the sublimed and transferred amount of dyes can be controlled by changing the energy for heating the dyes to facilitate gradation recording and hence the sublimation system is considered to be particularly advantageous for full color recording.

In thermal transfer recording by the sublimation system, sublimable dyes which are used for a transfer sheet are very important since they give large influences on the thermal recording speed, the image quality, storage stability, etc., of the record and are required to meet the following conditions:

(1) The dye easily sublimes by the working condition of an ordinary heating means such as a thermal recording head, etc.

(2) The dye does not cause thermal decomposition under the aforesaid working condition before sublimation.

(3) The dye has a preferred hue for color reproduction.

(4) The dye has a large molecular extinction coefficient.

(5) The dye is stable to heat, light, moisture, chemicals, etc.

(6) The dye can be easily synthesized.

(7) The dye is excellent in ink-making aptitude.

Furthermore, for obtaining black recording by thermal transfer recording of sublimation system, transfer recording is performed using a transfer sheet having a black color material layer of a mixture of yellow, magenta, and cyan colors but conventional black transfer sheets are yet insufficient in performance and hence the development of a black transfer sheet having satisfactory performance has been desired.

SUMMARY OF THE INVENTION

The object of this invention is, therefore, to provide a black transfer sheet having a color material layer containing black dyes satisfying the above-described various conditions that they easily sublime under the working condition of a heat-sensitive recording head, compounding yellow, magenta, and cyan dyes are well-matched in sublimability, they have preferred hues, etc.

It has now been found that the above-described object can be attained by the present invention as set forth below.

That is, according to this invention, there is provided a transfer sheet for thermal transfer recording system having a color material layer containing sublimable dyes on one surface of a base film, said color material layer being a black color material layer containing sublimable dyes represented by following formulae (I), (II), and (III), respectively;

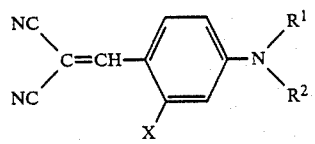

(I)

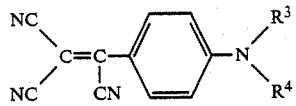

(II)

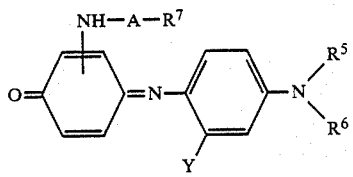

(III)

in the above formulae, X and Y represent a hydrogen atom or a methyl group; —A— represents —CO—, —COO—, or —$SO_2$—; and $R^1$, $R^2$, $R^3$, $R^4$, $R^5$, $R^6$, and $R^7$ represent a hydrogen atom or a substituted or unsubstituted alkyl group.

DETAILED DESCRIPTION OF THE INVENTION

Then, the invention is explained below in detail. The substituted or unsubstituted alkyl group shown by formula $R^1$ to $R^7$ in formulae (I), (II), and (III) described above includes a substituted or unsubstituted alkyl group having from 1 to 6 total carbon atoms and a phenyl substituted alkyl group having from 7 to 9 total carbon atoms.

As the alkyl group for the substituted or unsubstituted alkyl group shown by $R^1$ and $R^2$ in formula (I) showing a yellow dye for use in this invention, there are an alkyl group having from 1 to 4 carbon atoms, examples of the substituent of the substituted alkyl group, being —CH, —$OCH_3$,

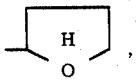

and —$OCOCH_3$, and a phenyl-substituted alkyl group having from 7 to 9 carbon atoms. In the compound represented by formula (I) described above, the comas methylcellosolve, ethyl cellosolve, etc.; aromatics such as toluene, xylene, chlorobenzene, etc.; esters such as ethyl acetate, butyl acetate, etc.; ketones such as acetone, methyl ethyl ketone, methyl isobutyl ketone, cyclohexanone, etc.; chlorine series solvents such as methylene chloride, chloroform, trichloroethylene, etc.; ethers such as tetrahydrofuran, dioxane, etc.; and other organic solvents such as N,N-dimethylformamide, N-methylpyrrolidone, etc.

The aforesaid ink for use in this invention may further contain, if necessary, organic or inorganic fine non-sublimable particles, a dispersing agent, an antistatic agent, a blocking preventing agent, a defoaming agent, an antioxidant, a viscosity controlling agent, etc.

A base film for the transfer sheet of this invention is required to meet the properties that the film is dense and thin for increasing the heat conductivity thereof, the film has high heat resistance, the film can be coated with a uniform transfer layer, the film has high flatness for improving the contact with a thermal head, and the film does not cause ooze of ink to the back surface thereof. Suitable examples of the base film are tissue papers such as condensor papers, glassine papers, etc., and films of a plastic having high heat resistance, such as polyester, polyamide, polyimide, etc, and the thickness of the base film is in the range of from 3 μm to 50 μm. In the aforesaid base films, the films of polyethylene terephthalate or polyimide are preferred and a polyethylene terephthalate film is particularly preferred.

The thermal transfer sheet of this invention fundamentally has a color material layer containing the dyes described above on the surface of a base film but as the case may be, the transfer sheet may have a smooth heat-resisting layer on the back surface thereof for improving the smooth running and heat resistance thereof for a thermal head. Such a back layer is formed by usually coating additives such as an inert inorganic compound (e.g., fine silica particles, etc.,), a lubricant, a surface active agent, etc., one the back surface of the base film together with a resin such as an epoxy resin, an acrylic resin, a urethane series resin, a polycarbonate series resin, etc.

The ink can be coated on a base film by the conventional means, for example, using a reverse roll coater, a gravure coater, a rod coater, an air doctor coater, etc., and the thickness of the inkcoated layer may be in the range of from 0.1 to 5 μm as dry thickness (see, for example, Yuji Harazaki, *Coating,* published by Maki Shoten, 1979).

The color material layer of the black transfer sheet of this invention contains easily sublimable dyes the sublimabilities of which are matched each other and hence recording of high color density can be obtained at high speed without giving large load to a heating means such as a thermal head, etc. Furthermore, since the dyes for use in this invention are stable to heat, light, moisture chemicals, etc., they do not cause thermal decomposition during transfer recording and also the record obtained is excellent in storage stability. Also, since the dyes for use in this invention have good solubility for organic solvents and good dispersibility for water, the high density ink containing uniformly dissolved or dispersed dyes can be easily prepared and by using the ink, a transfer sheet uniformly coated with the dyes at high density can be obtained. Accordingly, by using the transfer sheet, records having good homogeneity and high color density can be obtained.

The following examples are intended to illustrate this invention practically but not to limit it on any way. In the Examples, a percent shows based on a weight.

EXAMPLE 1

(a) Preparation of Ink:

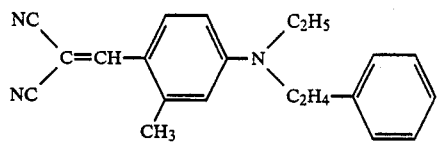

(1-1)

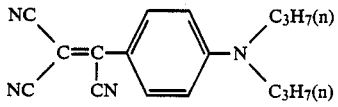

(1-2)

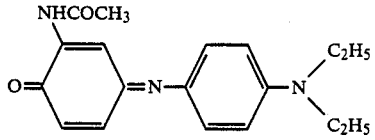

(1-3)

| | | Compounding Ratio |
|---|---|---|
| Compounding Dye (1-1) | 2.6 g | (26%) |
| Compounding Dye (1-2) | 2.1 g | (21%) |
| Compounding Dye (1-3) | 5.3 g | (53%) |
| Polysulfone Resin* | 10 g | |
| Chlorobenzene | 80 g | |
| Sum | 100 g | |

*Yudel P-1700, trade name, made by Nissan Chemical Industries, Ltd.

A mixture of the above-described components was treated by means of a paint conditioner for 10 minutes to prepare an ink. In this case, the dyes and the resin were completely dissolved in the solvent and the ink could be obtained as a homogeneous solution.

(b) Preparation of Transfer Sheet: The ink prepared above was coated on a polyimide film of 15 μm in thickness using a bar coater (No. 1, made by RK Print Coat Instrument Co.) and then dried to provide a transfer sheet.

(c) Transfer Recording:

The ink-coated surface of the aforesaid transfer sheet was placed on a recording material and transfer recording was performed using a thermal head under the following conditions, whereby uniform and high color density records of clear black (color density of 1.60) could be obtained.

| Recording Condition | |
|---|---|
| Line density of main scanning and side scanning: | 4 dots/mm |
| Recording electric power: | 0.6 W/dot |
| Heating time of head: | 10 msec. |

In addition, the recording material used in this example was prepared by coating a solution prepared by mixing 10 g of an aqueous dispersion of 34% by weight saturated polyester (Vyronal MD-1200, trade name, made by Toyobo Co., Ltd.) and 1 g of silica (Nipsil E220A, trade name, Made by Nippon Silica Kogyo K.K.) on a wood free paper of 200μm in thickness using a bar coater (No. 3, made by RK Print Coat Instrument Co.) followed by drying.

The color density was measured using a densitometer, Type RD-514, made by Macbeth Co. in the U.S.A. (using a filter: Wratten No. 106).

The light fastness of the record thus obtained was tested using a carbon arc fade-o-meter (made by Suga Shikenki K.K.) at a black panel temperature of 63° C.±2° C. and it was confirmed that the record showed almost neither discoloring nor fading after the irradiation for 40 hours.

Also, a* and b* in colorimetric system CIE 1976 (L*a*b*) of the transferred record were −1.54 and −2.74, respectively. The colorimetry was performed using a spectroscopic color-difference meter Type SZ-Σ80, made by Nippon Denshoku Kogyo K.K.

EXAMPLE 2

Preparation of inks, preparation of transfer sheets, and transfer recordings were practiced by the same manner as Example 1 using dyes shown in Table 1 below in place of the dyes used in Example 1 and as the results thereof, clear black color records of color densities shown in Table 1 could be obtained.

The light fastness test of the records obtained and the storage stability test of the transfer sheets and records in the dark were conducted and the results obtained were good.

TABLE 1

| No. | Structure of Dye | Compounding Ratio | Color Density of Record |
|---|---|---|---|
| 2-1 | 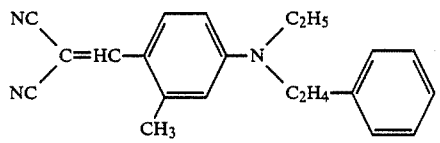 | 22% | 1.60 |
| | 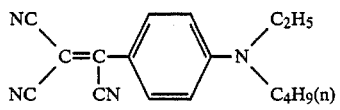 | 22% | |
| | 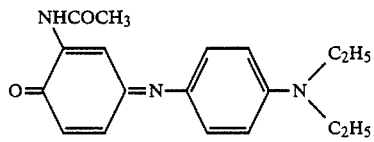 | 56% | |
| 2-2 | 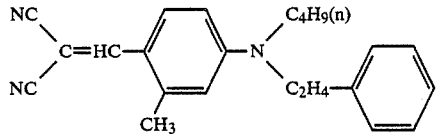 | 24% | 1.60 |
| | 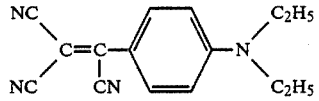 | 19% | |
| | 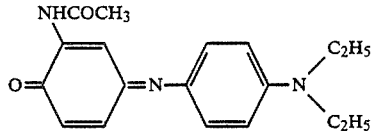 | 57% | |
| 2-3 | 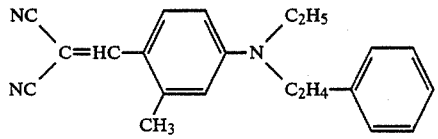 | 24% | 1.60 |
| | 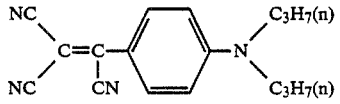 | 19% | |
| | 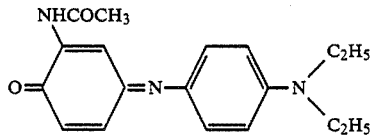 | 29% | |

TABLE 1-continued
| No. | Structure of Dye | Compounding Ratio | Color Density of Record |
|---|---|---|---|
| | 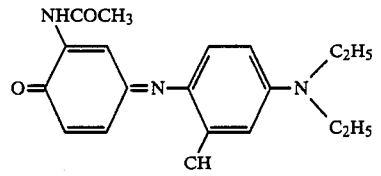 | 28% | |
| 2-4 | 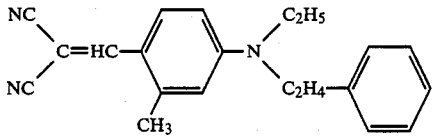 | 25% | 1.60 |
| | 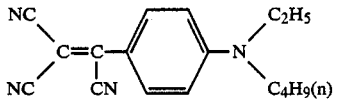 | 19% | |
| | 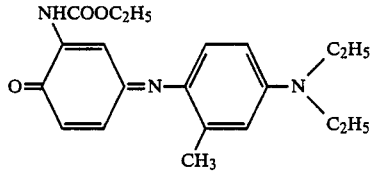 | 56% | |
| 2-5 | 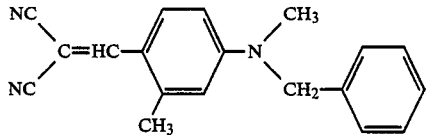 | 21% | 1.50 |
| | 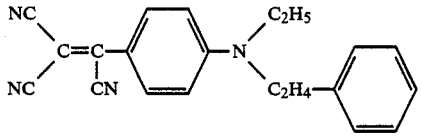 | 20% | |
| | 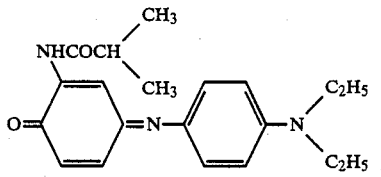 | 59% | |
| 2-6 | 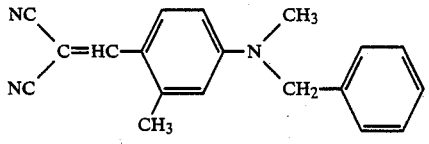 | 23% | 1.50 |
| | 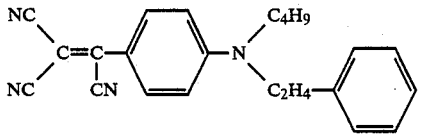 | 23% | |

TABLE 1-continued
| No. | Structure of Dye | Compounding Ratio | Color Density of Record |
|---|---|---|---|
| | 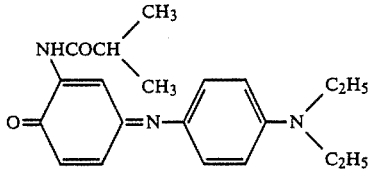 | 27% | |
| | 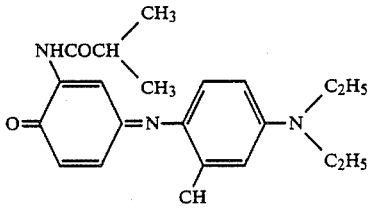 | 27% | |
| 2-7 | 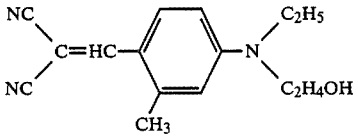 | 26% | 1.55 |
| | 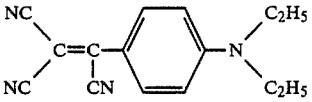 | 20% | |
| | 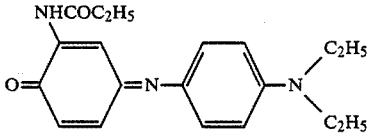 | 54% | |
| 2-8 | 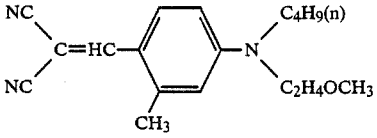 | 25% | 1.50 |
| | 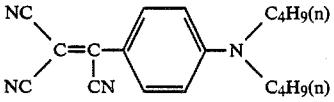 | 20% | |
| | 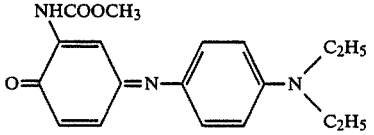 | 55% | |
| 2-9 | 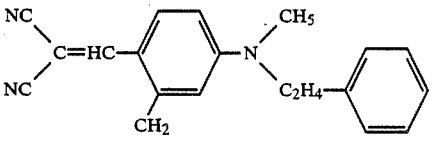 | 19% | 1.60 |
| | 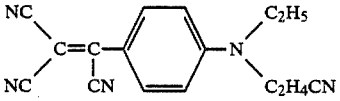 | 15% | |

TABLE 1-continued
| No. | Structure of Dye | Compounding Ratio | Color Density of Record |
|---|---|---|---|
| | 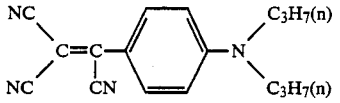 | 10% | |
| | 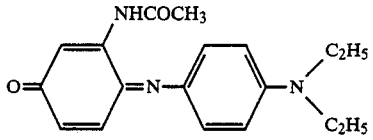 | 19% | |
| | 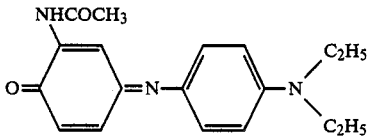 | 19% | |
| | 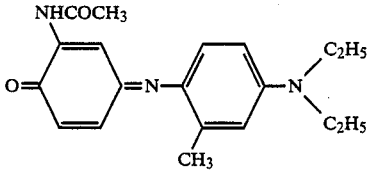 | 18% | |
| 2-10 | 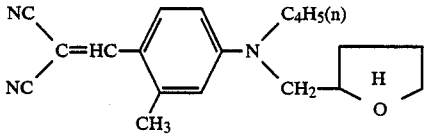 | 20% | 1.50 |
| | 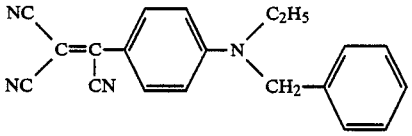 | 25% | |
| | 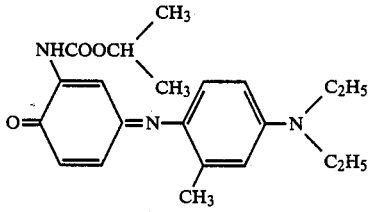 | 55% | |
| 2-11 | 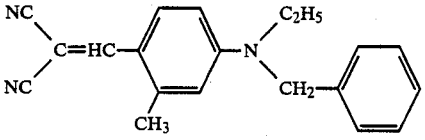 | 20% | 1.50 |
| | 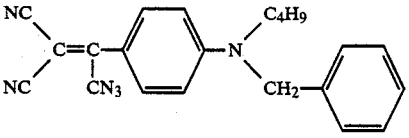 | 25% | |
| | 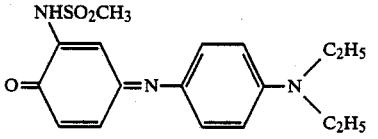 | 55% | |

TABLE 1-continued
| No. | Structure of Dye | Compounding Ratio | Color Density of Record |
|---|---|---|---|
| 2-12 | 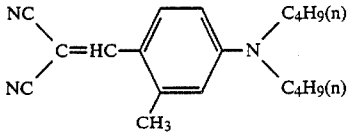 | 19% | 1.55 |
| | 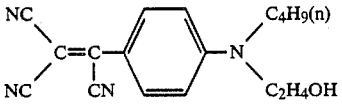 | 26% | |
| | 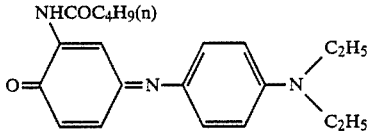 | 28% | |
| | 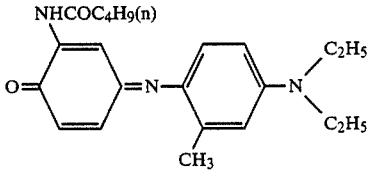 | 27% | |
| 2-13 | 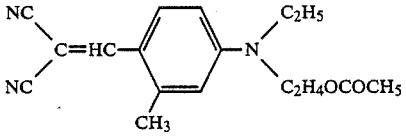 | 25% | 1.50 |
| | 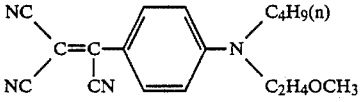 | 22% | |
| | 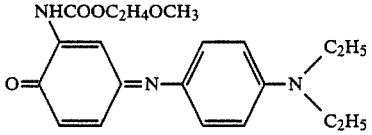 | 53% | |
| 2-14 | 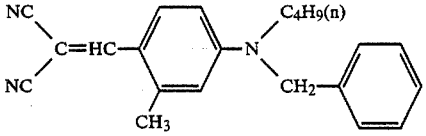 | 20% | 1.50 |
| | 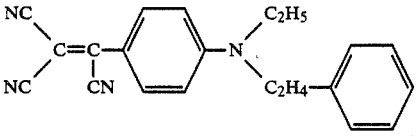 | 25% | |
| | 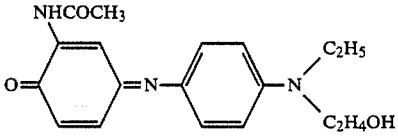 | 55% | |

TABLE 1-continued
| No. | Structure of Dye | Compounding Ratio | Color Density of Record |
|---|---|---|---|
| 2-15 | 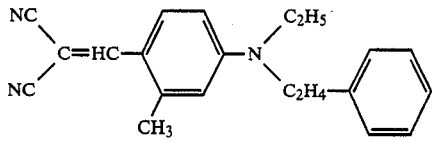 | 20% | 1.50 |
| | 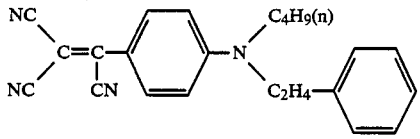 | 26% | |
| | 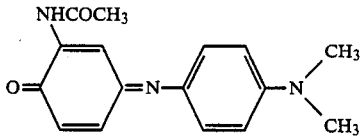 | 27% | |
| | 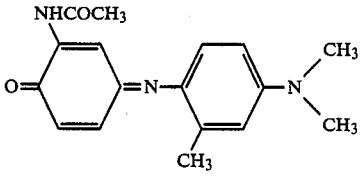 | 27% | |
| 2-16 | 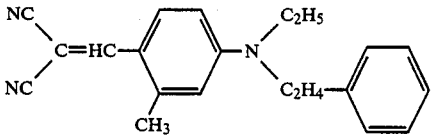 | 25% | 1.60 |
| | 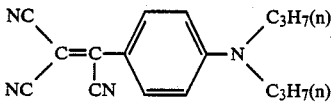 | 19% | |
| | 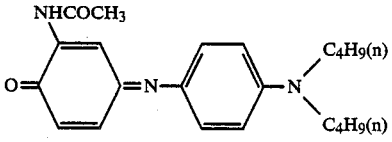 | 56% | |
| 2-17 | 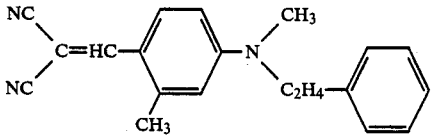 | 25% | 1.60 |
| | 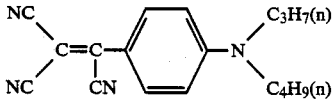 | 20% | |
| | 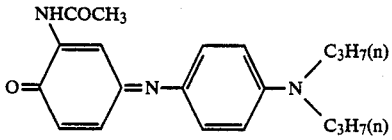 | 55% | |

TABLE 1-continued
| No. | Structure of Dye | Compounding Ratio | Color Density of Record |
|---|---|---|---|
| 2-18 | 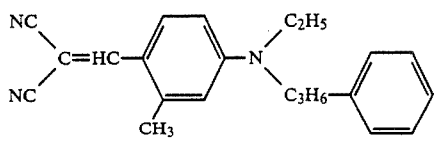 | 23% | 1.60 |
| | 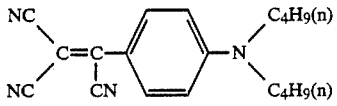 | 20% | |
| | 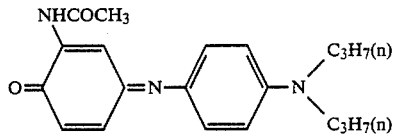 | 29% | |
| | 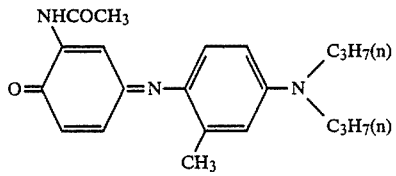 | 28% | |
| 2-19 | 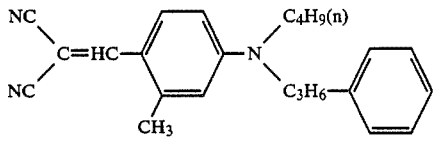 | 26% | 1.60 |
| | 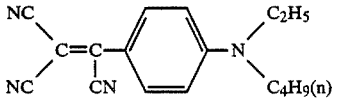 | 19% | |
| | 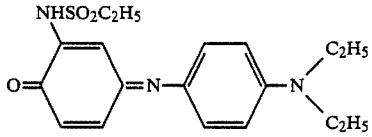 | 55% | |
| 2-20 | 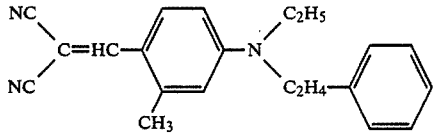 | 20% | 1.50 |
| | 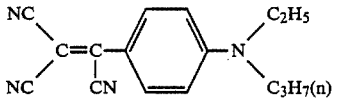 | 20% | |
| | 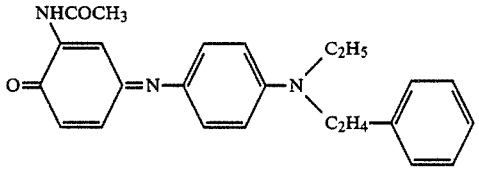 | 60% | |

TABLE 1-continued

| No. | Structure of Dye | Compounding Ratio | Color Density of Record |
|---|---|---|---|
| 2-21 | 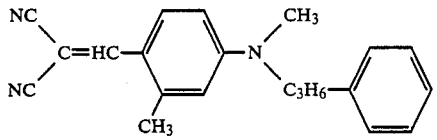 | 21% | 1.55 |
| | 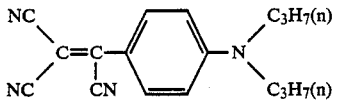 | 19% | |
| | 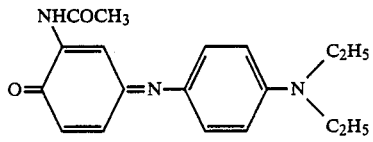 | 30% | |
| | 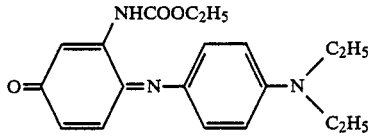 | 30% | |

EXAMPLE 3

An ink was prepared by the same manner as Example 1 using the following amounts of dyes (3 - 1), (3 - 2), and (3 - 3) shown below in place of the dyes used in Example 1.

(3-1)

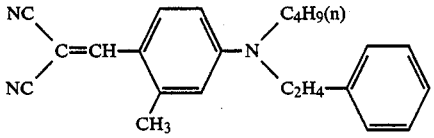

(3-2)

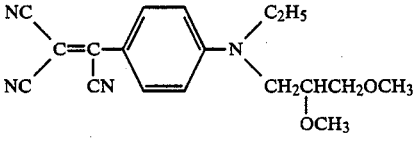

(3-3)

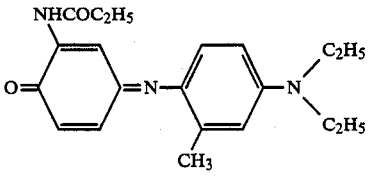

| | | Compounding Ratio |
|---|---|---|
| Compounding Dye 3-1 | 1.5 g | (15%) |
| Compounding Dye 3-2 | 2.0 g | (20%) |
| Compounding Dye 3-3 | 6.5 g | (65%) |

When a transfer sheet was prepared using the ink prepared by the same manner as Example 1 except that a polyethylene terephthalate film was used as the base film and transfer recording was preformed using the transfer sheet by the same manner as Example 1, a black record having a* value of −4.85, b* value of −3.43, and a color density of 1.35 was obtained.

When a light fastness test of the record obtained was performed by the same manner as Example 1, almost neither discoloring nor fading of the record was observed.

COMPARISON EXAMPLE 1

When an ink was prepared by the same manner as Example 3 using a dye (A) shown below in place of the dye (3—3) in Example 3 as the compounding dye, a transfer sheet was prepared using the ink, and transfer recording was performed using the transfer sheet by the same manner as Example 3, a black record having a* value of 1.64 and b* of 4.89 could be obtained but the color density thereof was 1.07.

Also, then the light fastness test was conducted on the record thus obtained by the same manner as Example 3, the record was disclosed into brown.

(A)

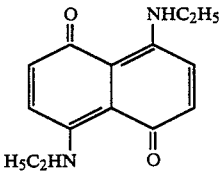

While the invention has been described in detail and with reference to specific embodiment thereof, it will be apparent to one skilled in the art that various changes and modifications can be made therein without departing from the spirit and scope thereof.

What is claimed is:

1. A transfer sheet for thermal transfer recording system having a color material layer containing sublimable dyes on one surface of a base film, said color material layer being a black color material layer containing sublimable dyes represented by following formulae (I), (II) and (III);

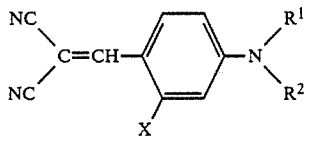

(I)

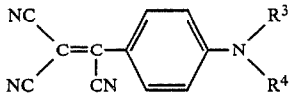

(II)

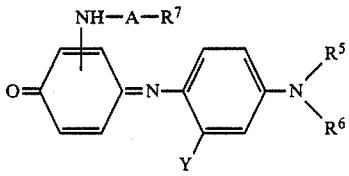

(III)

in the above formulae, X and Y represent a hydrogen atom or a methyl group; —A— represents —CO—, —COO—, or —$SO_2$—; and $R^1$, $R^2$, $R^3$, $R^4$, $R^5$, $R^6$, and $R^7$ represent a hydrogen atom or a substituted or unsubstituted alkyl group.

2. The transfer sheet as claimed in claim 1, wherein $R^1$ to $R^7$ of formulae (I), (II), and (III) are a substituted or unsubstituted alkyl group having from 1 to 6 carbon atom or a phenyl-subsituted alkyl group having from 7 to 9 carbon atoms.

3. The transfer sheet as claimed in claim 1, wherein $R^1$ and $R^2$ in formula II) are an alkyl group having from 1 to 4 carbon atoms, an alkyl group having from 1 to 4 carbon atoms substituted by at least one of —OH, —$CH_3$,

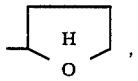

and —$OCOCH_3$, or a phenyl-substituted alkyl group having from 7 to 9 carbon atoms.

4. The transfer sheet as claimed in claim 1, wherein $R^3$ and $R^4$ in formula (II) are an alkyl group having from 1 to 4 carbon atoms, an alkyl group having from 1 to 4 carbon atoms substituted by at least one of —$OCH_3$, —OH, and —CN, or a phenyl-substituted alkyl group having from 7 to 9 carbon atoms.

5. The transfer sheet as claimed in claim 1, wherein $R^5$ and $R^6$ in formula (III) are an alkyl group having from 1 to 4 carbon atoms, an alkyl group having from 1 to 4 carbon atoms substituted by —OH, or a phenyl-substituted alkyl group having from 7 to 9 carbon atoms and $R^7$ in formula (III) is an alkyl group having from 1 to 4 carbon atoms or an alkyl group having from 1 to 4 carbon atoms substituted by —$OCH_3$.

6. The transfer sheet as claimed in claim 1, wherein the color material layer contains the dye of formula (I) in an amount of from 10 to 50% by weight, the dye of formula (II) in an amount of from 10 to 50% by weight, and the dye of formula (III) in an amount of from 30 to 80% by weight.

7. The transfer sheet as claimed in claim 1, wherein the color material layer contain the dye of formula (I) in an amount of from 15 to 35% by weight, the dye of formula (II) in an amount of from 10 to 25% by weight, and the dye of formula (III) in an amount of from 45 to 65% by weight.

8. The transfer sheet as claimed in claim 1, wherein in formulae (I), (II), and (III), X and Y are a methyl group; $R^1$, $R^3$, $R^5$, $R^6$, and $R^7$ are an alkyl group having from 1 to 4 carbon atoms; $R^2$ is a phenyl-subsituted alkyl group having from 7 to 9 carbon atoms; $R^4$ is an alkyl group having from 1 to 4 carbon atoms substituted by a methoxy group; and —A— is —CO—.

9. The transfer sheet as claimed in claim 1, wherein the color material layer contains the following dyes

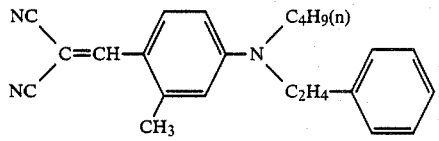

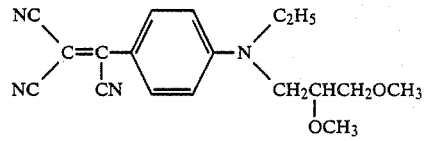

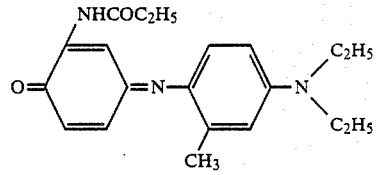

as the dyes shown by formulae (I), (II), and (III), respectively.

10. The transfer sheet as claimed in claim 1, wherein the base film is a polyimide film or a polyethylene terephthalate film.

11. The transfer sheet as claimed in claim 1, wherein the thickness of the base film is from 3 μm to 50 μm.

12. The transfer sheet as claimed in claim 1, wherein the thickness of the color material layer is from 0.1 μm to 5 μm.

* * * * *